United States Patent [19]

Styring, Jr.

[11] 4,218,304

[45] Aug. 19, 1980

[54] RETORTING HYDROCARBONACEOUS SOLIDS

[75] Inventor: Ralph E. Styring, Jr., Dallas, Tex.

[73] Assignee: Atlantic Richfield Company, Los Angeles, Calif.

[21] Appl. No.: 973,834

[22] Filed: Dec. 28, 1978

[51] Int. Cl.[2] ..... C10G 1/00; C10G 1/02

[52] U.S. Cl. ..... 208/8 R; 208/11 R

[58] Field of Search ..... 208/11 R, 8 R

[56] References Cited

U.S. PATENT DOCUMENTS

| | | | |
|---|---|---|---|
| 3,736,247 | 5/1973 | Jones et al. | 208/11 R |
| 3,841,992 | 10/1974 | Jones et al. | 208/11 R |
| 4,042,485 | 8/1977 | Jones et al. | 208/11 R |
| 4,152,243 | 5/1979 | Legille et al. | 208/11 R |

*Primary Examiner*—Herbert Levine

*Attorney, Agent, or Firm*—M. David Folzenlogen

[57] ABSTRACT

Mined, crushed hydrocarbonaceous solids are pyrolyzed in a retort with a gas containing hydrocarbons. The gas is heated to a suitable temperature of at least 600° F. Thereafter, a relatively small amount of oxygen is added to the heated gas outside the retort. The resulting mixture is then flowed into the retort. The amount of oxygen is theoretically sufficient to raise the temperature of the heated gas at least 100° F., but is less than the amount theoretically sufficient to react with all of the hydrocarbons in the heated gas. The process is applicable to any type of retort wherein a retort recycle gas containing hydrocarbons is heated outside the retort and is then injected into the retort to provide a source of heat for pyrolyzing hydrocarbonaceous solids in the retort. The advantages of this modified indirect heated retorting method depends on the type of retort. This method provides added control over carbonate decomposition, coking or carbonization of the gas during heating, total gas flow, process variations, and the heat requirements and thermal efficiency of the process.

8 Claims, 1 Drawing Figure

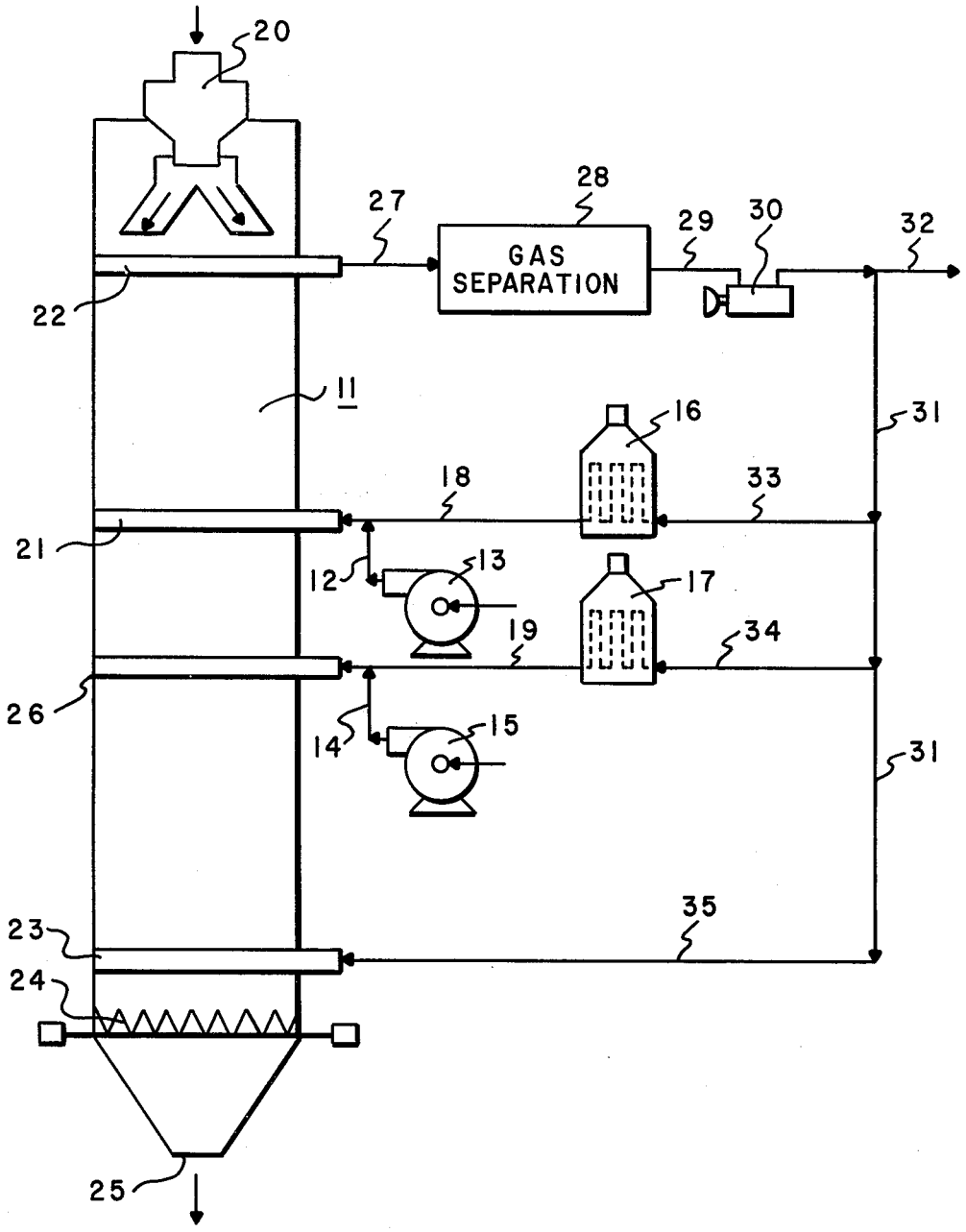
20
27
28
GAS SEPARATION
29
30
32
22
11
16
31
18
33
21
12
13
17
19
34
26
14
15
31
35
23
24
25

RETORTING HYDROCARBONACEOUS SOLIDS

BACKGROUND OF THE INVENTION

This invention relates to a modified indirect gas heated retorting process for retorting hydrocarbonaceous solids. More specifically, a relatively small amount of oxygen is combined with retort produced recycle gas after the recycle gas has been heated, but before it is flowed into the retort.

As used herein, the term retorting refers only to the injection of a gas into a vessel containing crushed mined oil shale, coal or tar sands to thermally convert or pyrolyze the organic hydrocarbonaceous matter in these normally solid hydrcarbonaceous materials at temperatures in excess of 600° F. (315° C.) to gases and oil mist or droplets. The retort vessel will normally be aboveground, but it might be placed or formed in a hole or tunnel in the ground near the surface of the earth. Such term, for example, does not include in situ retorting processes, retorting processes relying on heat transfer between hot heat carrying solids and the hydrocarbonaceous solids being retorted, or liquefaction processes using heated liquids or slurries.

Retorting processes using gases to heat and convert normally solid hydrocarbonaceous matter are generally classified as being either a combustion retorting process, or an indirect heated retorting process, or a combination combustion-indirect heated retorting process. In the combustion process, oxygen (e.g., air, oxygen with steam, oxygen with carbon dioxide, etc.) is injected at one or more points into a bed of hydrocarbonaceous solids to burn hydrocarbonaceous matter in the solids. In the combustion process, this provides the heat for retorting the solids. In the indirect heated process, recycle gas derived from the retort is heated in a separate furnace. The heated recycle gas is then injected at one or more points into a bed of hydrocarbonaceous solids. The heat content of the recycle gas provides the heat for retorting the solids. In the combination process, heated recycle gas is injected into a bed of solids while an oxygen containing combustion gas is injected at another point into the solids after the solids have already been partially pyrolized by the heated recycle gas. The oxygen burns hydrocarbonaceous matter remaining after the solids have been retorted by heated recycle gas. These gas retorting processes may be used in batch or continuous fashion and many types of retort vessels have been proposed. For example, U.S. Pat. No. 3,361,644 describes an indirect heated process wherein heated recycle gas is flowed downward through a bed of solids while a rock pump pushes crushed mined hydrocarbonaceous solids upward through a vertical retort. U.S. Pat. No. 3,841,992 describes an indirect heated process wherein the hydrocarbonaceous solids are fed downward through a vertical retort while heated recycle gas is injected at two central points. Revolving and traveling grate-type retorts may also be adapted to the indirect heated recycle gas retorting process.

In order to illustrate the relationship between objectives of this invention and the prior art gas retorting processes, a typical gas retorting process will be considered as having a final preheating zone, a final pyrolysis zone, and a spent solids cooling zone. Actually, in a vertical retort, the preheating and pyrolysis zones are not distinct. For this illustration, several interrelated conditions will be mentioned. In some respects, these conditions depend on the type of retort. For example, the rock pump, upwardly fed vertical retort has considerations involving similar theories, but which are twisted around or act differently. For sake of simplicity, this description of the prior art concerns will generally be limited to the vertical retorts wherein the solids flow downwardly while the gases flow upwardly.

In a gas retorting process, gas flows through a bed of solids. It is desirable to keep the rate and total amount of gas flow at the minimum required for retorting. Increasing the rate of gas flow causes a number of problems. The solids in the bed are not uniform and at higher rates, there is greater channeling. This results in insufficient heat distribution. At higher rates, solid particles are entrained in the gas. These particles can plug the bed and increase channeling. In addition, entrained particles which are not left in the bed contaminate liquid products obtained from the retort effluents. These contaminants are difficult to remove without loss of valuable product. In the pyrolysis zone of the retort, gases and oil mist or droplets are produced. The bed of solids has some aspects of a mechanical separator and at higher gas rates, there is both a condensation-reflux effect and effects of droplet enlarging and striking the solids at sufficient force to stick and be carried back into the pyrolysis zone. The rate of gas flow also affects size and nature of separate equipment for treating the retort effluents and for handling the gas to the retort.

As previously mentioned, the retort produces a gas. It is desirable that the gas have as high a BTU content as is feasible. Combustion retort processes, especially those using air, produce lower BTU content gas than the indirect heated process. From this and other standpoints, the indirect heated process is preferred. But the indirect heated process has disadvantages. The heat for pyrolysis comes from the heat content of recycle gas which is heated in a separate furnace. For this discussion, it is assumed that heat content of the heated recycle gas is dependent on its temperature and specific heat. The specific heat of the gas is small in comparison to the specific heat of the solids in the retort. At the same time, there are limits to which the recycle gas can be heated in the furnace. Furnaces are relatively inefficient. The furnace must be operated at a higher temperature than the recycle gas. The furnace residence time affects the degree of heat transfer. The recycle gas contains hydrocarbons. At the temperatures required for standard indirect heated processes, coking or carbonization of the recycle gas is a problem. Coke fouls the furnace tubes decreasing heat transfer efficiency and creating plugging problems in the furnace and in piping leading from the furnace to the retort. When the temperature is lowered to reduce coking, the amount of heated gas needed to supply heat for the retort goes up. This increases the flow rate of gas in the retort, creating the problems previously mentioned. This can also affect the rate at which the retort can handle solids.

In some indirect heated retorts, after leaving the pyrolysis zone, the spent or pyrolyzed solids are cooled by passing an unheated portion of the retort effluent gas through the spent solids. When this cooling gas reaches the pyrolysis zone, it comingles with the incoming heated recycle gas from the furnace and the gas flow rate in the pyrolysis and preheat parts of the retort is dependent on the total flow of these two gas streams and the gases generated by pyrolysis. If the cooling gas is at a lower temperature than the pyrolysis zone, there will be added heat burdens on the heated recycle gas. This increases the total amount of heated recycle gas that is injected into the retort which as previously mentioned in undesirable. If the flow rate of the cooling gas is reduced so that when the gas reaches the pyrolysis zone, it will have nearly the same temperature as the pyrolysis zone, the exit temperature of the spent solids from the retort is too high. In general, the process is designed to balance the two rates of gas flow in a way that maximizes thermal efficiency without causing other problems. In some processes, the spent solids are taken from the retort without cooling, but this lowers the thermal efficiency of the overall process and requires water for quenching the solids. In areas where hydrocarbonaceous deposits are found, water is frequently scarce. If the water is recovered and recycled, additional water treating equipment is required. Even when water is more abundant, there is a water disposal problem.

The combination indirect heated-combustion process was proposed as a compromise between the easier to operate combustion retort and the product advantages of the indirect heated process. In this combined process, in order to avoid burning valuable products, the externally heated recycle gas is injected into the retort at a point ahead of the combustion gas. In other words, the combustion portion of the retort burns hydrocarbonaceous matter left after the solids have been partially retorted by the heated recycle gas. The combined process has disadvantages. The retort effluent gas has a lower BTU value than the gas by the indirect heated process, especially if air is used. In addition, if unheated retort effluent recycle gas is used to cool the spent solids, the combustion part of the retort consumes the hydrocarbons in the recycle gas. If inert gases are used to cool the solids, the BTU value of the gas product is lowered. In comparison to the indirect heated process, combustion of the residual hydrocarbonaceous matter increases the amount of cooling gas that is required and increases gas flow rates in the retort. Combustion also increases the decomposition of carbonates in the inorganic mineral matter in the solids. For example, in a test at 1100° F. (593° C.), the percent of decomposition of the carbonate was 25.6 percent by weight while at 950° F. (510° C.), the percent of decomposition was 2.6%. Energywise the higher degree of decomposition is equivalent to using 27 pounds of oxygen per ton (13.5 grams per kilogram) of feed. In other words, higher gas flows are required. Combustion increases the disintegration of the crushed solids. It is, therefore, desirable to minimize the amount of combustion in the retort provided that there is not an offsetting loss in other parts of the retort facilities.

The foregoing discussion of gas retorting processes illustrates some of the difficulties in fine tuning process. In addition, this shows some of the reasons why the processes are not flexible to inherent changes in conditions. For example, there are inherent variations in the hydrocarbon content or richness of the material to be retorted, in the flow and size of the solids, in ambient temperature, and in the furnace for heating the recycle gas. It is, therefore, desirable to provide a retorting process that provides better control or response to the conditions mentioned.

SUMMARY OF THE INVENTION

Crushed solid hydrocarbonaceous material from a coal, oil shale or tar sands mine is fed to retort which is operated at a temperature of at least 700° F. (371° C.) to produce a retort effluent mixture of carbonaceous oil vapors (oil gases and mist) and hydrocarbon gases. The effluent may also contain other gases or vapors produced or used in the retort. At least one stage of the retorting process is comprised of heating at least a portion of the hydrocarbon gases produced by the retort to a temperature of at least 600° F. (315° C.) and more preferably in some cases to a temperature of at least 900° F. (482° C.). This heating occurs outside the retort. The heated gas may be partially derived from sources other than the retort. After heating, at least a portion of the heated gas is mixed with another gas that is at least partially comprised of free oxygen. The temperature of the oxygen containing gas is not as high as the temperature of the heated gas. At least a portion of the resulting mixture is flowed into the retort at at least one point. The relatively small stream of oxygen containing gas is derived from sources independent of the retort and can be easily and quickly adjusted to meet the needs of the retort without adding an undesirably large amount of gas to the retort.

The amount of oxygen containing gas is between two limits. The lower limit is the amount of oxygen theoretically needed to react with hydrocarbons in heated gas and increase the temperature of the heated gas in the mixture by 100° F. This lowers the heating requirements of the furnace or heater used to heat the gas and reduces coking in the furnace.

The upper limit on the amount of oxygen containing gas is in all cases less than the amount needed to supply enough oxygen to react with all of the hydrocarbons in the heated gas in the mixture. This avoids injecting enough oxygen to cause combustion in the retort. More preferably, the upper limit is equal to or less than the amount calculated to raise the temperature of the heated gas in the mixture to a temperature of at least 900° F. (482° C.).

BRIEF DESCRIPTION OF THE DRAWING

The drawing is a schematical and diagrammatical flow illustration of a system for carrying out a preferred sequence of the retorting method.

DETAILED DESCRIPTION OF THE PREFERRED EMBODIMENTS

The normally solid hydrocarbonaceous organic matter in oil shale, coal or tar sands is pyrolyzed or retorted in retort 11 which is operated at a temperature of at least 700° F. (371° C.). The term retorting has been previously defined, but in this invention at least one stage or part of heating the solids in the retort involves injecting a heated gas into the retort. This stage may be combined with one or more similar stages or with other gas retort process stages. The process is applicable to any type retort suitable for gas retorting. Retorts are usually operated at an average retort temperature of between 800° F. (426° C.) and 1200° F. (649° C.).

The following description of the preferred embodiments of this invention will use a downwardly fed indirect heated vertical retort. In the drawing, the equipment itself is known and for the most part the arrangement of the equipment is known. In the drawing, the arrangement of the equipment differs from the prior art in the placement and purpose of injection line 12 and blower 13 and of optional injection line 14 and optional blower 15. It is to be noted that injection line 12 is outside retort 11 and is between the retort and gas heater 16. In a similar manner, optional injection line 14 is between the retort and optional heater 17. These injection lines and blowers are used for mixing a relatively small amount of oxygen with a gas which is heated in the heaters and which is passed by way of either retort heated gas inlet line 18 or optional retort heated gas inlet line 19. This relatively small amount of oxygen is readily adjusted to the needs of retort with less effect on the gas balances of the system.

Raw or fresh carbonaceous or hydrocarbonaceous material which was mined and crushed or ground to a suitable size for handling in the retort is fed directly from a crusher, or from a hopper or an accumulation system by way of crushed feed inlet 20 into retort 11. The usual size for the type of retort illustrated is between 0.12 and 6 inches (0.3 and 15.2 centimeters). The rate of feed is directly or indirectly metered so that the column of solids in the retort is uniformly maintained. Feed and metering systems are well known and any convenient system may be used. In the type of retort being described, metering is usually tied to the discharge system for the solids. The feed system also may include any convenient system for distributing the solids uniformly in the retort. As shown, the feed inlet system is depicted as having distributing tubes. The crushed feedstock may or may not be preheated by direct or indirect means.

The crushed feed solids move downwardly through retort 11 at a suitable rate for the retort and progressively pass through a final preheating zone, a pyrolysis zone, and a cooling zone. At the same time as the crushed solids are being fed to the retort, at least one stage of heated gas is being injected by way of heated gas inlet line 18 into the retort. In other words, externally heated gas supplies a significant part of the heat for the pyrolysis zone. For this illustration, the heated gas inlet is shown as having typical heated gas inlet distributor 21 which distributes the gas into the bed of downwardly moving solids. Above inlet distributor 21 is retort effluent collector 22 which is adapted to pass retort oil vapors and gases out of retort 11. In this manner, when heated gas is injected into the retort through distributor 21, the gas flows upward through the downwardly moving bed of solids and into collector 22 where the gas exits the retort. The retort may be maintained under any pressure which does not hamper efficient operation of the retorting system. The heated gas is at a suitable temperature which is hot enough to retort hydrocarbonaceous matter in the crushed mined solids. As the heated gas flows upwardly in the retort, some of the heat content or sensible heat of the gas is transferred to the solids and the gas becomes progressively cooler. In contrast, as the solids move downwardly in the retort, they become progressively hotter. Water and hydrocarbons in the solids are distilled, and at the appropriate temperature, hydrocarbonaceous matter in the solids is decomposed, distilled, and cracked into gaseous and condensible oil fractions, thereby forming valuable vapor effluents including hydrocarbon gases, oil vapors (including mist or droplets).

Pyrolysis and vaporization of the feedstock leaves particulate spent mineral matter which contains relatively small amounts of unvaporized or coked organic carbon-containing material. As shown, below the pyrolysis section of the retort is cooling gas inlet distributor 23. Cooling gas injected into this distributor flows upwardly in the retort picking up heat from the spent particles. Eventually at the pyrolysis zone, this gas combines with the heated gas and becomes part of the retort effluents or off gas. In this manner, as the spent solids move downwardly they are cooled to a suitable exit temperature. The spent solids pass through grate system 24 which is any convenient sort of grate arrangement for supporting the column of solids and for controlling the rate of exit of spent solids from the retort at exit 25.

The indirect heated gas pyrolysis stage may be supplemented by one or more other heat supplying stages. If one of the supplemental stages is a combustion stage, it should be located such that the heated gas does not pass through the combustion area. Preferably, as shown, a second indirect heated gas stage is injected into optional heated gas inlet distributor 26. Two stages allow the heated gas to be used at a lower temperature and provide a more uniform pyrolysis temperature.

The effluent oil vapors and hydrocarbon gases exit the retort through product line 27 where they are passed to an oil treating system. The products treating system is not described in detail and may be any form of system for treating, processing, or reacting the products provided that the treating system eventually leads to separating some noncondensable hydrocarbon gases which were originally derived from the retort. For illustration, the products treating system is simply shown as oil and gas separation stage 28. The gases recovered from the gas separation stage may contain other gases, for example, carbon dioxide, hydrogen, carbon monoxide, nitrogen, etc., produced in the retort or produced in the products treating system. This gas which is at least partially comprised of hydrocarbon gases derived from the retort is passed by way of gas line 29 to suitable blower or compressor 30. After compression, at least a portion of the gas is recycled back to the retorting process via recycle gas return line 31. The part of the gas, if any, that is not recycled is withdrawn from the retort system via gas product line 32. Other gases (not shown) may be added to the recycle gas in return line 31.

For this invention, at least a portion of the recycle gas is passed through gas heater inlet line 33 where the recycle gas is heated in separate furnace or gas heater 16 to a temperature of at least 600° F., and more preferably, to a temperature of at least 900° F. The typical gas heater is one or more burners which may burn residual carbonaceous substances produced in the retort facilities and hydrocarbon gases from the retort. The recycle gas flowing through the furnace is heated by contact with the flames or with hot refractory material which were heated by the burner flames. In this invention as hereafter explained, the recycle gas in the heater does not need to be heated to as high a temperature. This reduces coking of the hydrocarbons in the recycle gas and reduces fuel consumption by the less efficient heater.

The heated recycle gas leaves the heater by way of heated gas inlet 18. At a point outside the retort between heater 16 and retort 11, a separate second gas is mixed with at least a portion of the heated recycled gas. As shown the second gas may be injected into the heated recycle gas in inlet line 18, but for reasons hereafter made apparent it may be better to withdraw a side stream of heated recycle gas and add the second gas to the smaller stream so that the rate of reaction between the second gas and hydrocarbons in the heated recycle gas will be faster and more complete. The second gas is at least partially comprised of molecular oxygen and is at a temperature less than the temperature of the heated recycle gas in inlet line 18. The second gas may be oxygen, air, oxygen and steam, air and steam, oxygen and carbon dioxide, or any other mixture of oxygen and a gas, provided that the free oxygen is available for raising the temperature of the heated recycle gas. The second gas mixes with the heated recycle gas before it enters the retort and the free oxygen in the second gas reacts with hydrocarbons in the heated recycle gas. This reaction raises the temperature of the heated recycle gas. Thereafter, at least a portion of the resulting mixture of heated recycle gas and second gas is injected into retort 11.

In order to assure the desired results, the amount of second gas is controlled between two levels. The first or maximum level is less than the amount of second gas that is needed to supply enough oxygen to react with all of the hydrocarbons in the heated recycle gas in inlet line 18. A more preferred maximum level is hereinafter provided. The second or minimum level is a calculated theoretical amount which is at least as great as the amount needed to supply enough oxygen to raise the temperature of the heated recycle gas in inlet line 18 by a temperature of at least 100° F. (37.7° C.). This is a calculated minimum. In the calculation, it is assumed that all of the oxygen in the second gas reacts with hydrocarbons in the heated recycle gas. In other words, the amounts of hydrogen, carbon monoxide, hydrogen sulfide, or other oxidizable gases is ignored. For the calculation heat losses and the heat needed to heat this second gas and the products of combustion are not taken into account. In other words, the actual temperature rise will be less than the calculated rise. Unless there is enough hydrogen to affect the other factors, the heat of combustion of hydrogen is 51,600 BTU per pound. The average net heats of combustion of the hydrocarbons are 21,500 BTU per pound (11,945 gram-calorie per gram) of methane; 20,420 BTU per pound (11,345 gram-calorie per gram) of ethane; 19,930 BTU per pound (11,073 gram-calorie per gram) of propane; 19,670 BTU per pound (10,929 gram-calorie per gram) of butane; 19,500 BTU per pound (10,834 gram-calorie per gram) of pentane, and for other hydrocarbons a value of 19,000 BTU per pound (10,556 gram-calorie per gram) may be used. For purposes of this invention, when the hydrocarbon composition of the heated recycle gas is not known, an average net heat of combustion of 20,150 BTU per pound (11,334 gram-calorie per gram) of total hydrocarbons may be used. Of course, the heat of combustion of the total recycle gas stream will be much lower because the recycle gas usually contains appreciable amounts of water, carbon dioxide and lesser amounts of a long list of substances. As previously indicated, it is much preferred that the maximum amount of second gas not exceed the calculated amount necessary to increase the temperature of the heated recycle gas in gas inlet line 18 by 900° F. (482° C.). This preferred upper limit on the amount of second gas is calculated in the same manner as the minimum or lower limit. By way of example, assume that the recycle gas has been heated to 900° F. and that the weight percent of the hydrocarbons in the recycle gas is 38.05 methane, 10.98 ethane and 10.73 propane. The average specific heat of the recycle gas between 900° F. and 1000° F. is 0.81 BTU per pound —°F. The heat required to raise each pound of the gas 100° F. is 81 BTU. The net heat of combustion of the hydrocarbons in this gas is assumed to be 20,150 BTU per pound. Oxidizing 0.00402 pound (1.823 grams) of hydrocarbons in the recycle to carbon dioxide and water would produce the required 81 BTU. The calculated minimum amount of oxygen would be 0.01562 pounds of oxygen per pound of recycle gas. The calculated preferred maximum amount to raise the recycle gas 900° F. would be approximately nine times this amount after adjustment for the change in specific heat of the recycle gas between 900° F. and 1600° F. The absolute maximum amount of oxygen, which is the theoretical amount to react with all of the hydrocarbons in the recycle gas is 2.322 pounds of oxygen per pound of recycle gas assuming no other reactions. The total pounds of second gas will depend on the concentration of free oxygen in the second gas. From the foregoing, it can readily be seen that a relatively small amount of oxygen can be added at the required point to provide better control and response to the requirements of the retorting process.

As previously mentioned, a preferred embodiment of the retorting process includes two stages of separately heated gas. Accordingly, a portion of the recycle gas in recycle gas return line 31 is shown as being withdrawn through optional heater inlet line 34 and passed through furnace or gas heater 17. This second optional recycle gas stream is heated in a similar fashion and leaves the heater by way of optional retort heated gas inlet line 19. At a point outside the retort and between heater 17 and retort 11, an optional stream of a second gas which is at least partially comprised of oxygen is injected into the heated recycle gas in inlet line 19 or in a side stream (not shown). In a manner similar to that described, this optional second gas stream mixes with the heated recycle gas in inlet line 19 and the free oxygen in the second gas reacts with hydrocarbons in the heated recycle gas, thereby increasing the temperature of the heated recycle gas in line 19.

In the drawing, a portion of the recycle gas may also be used to supply cooling gas to the retort. Accordingly, a portion of the unheated recycle gas in return line 31 is withdrawn through cooling gas inlet line 35 and flowed to distributor 23.

The foregoing description of the instant invention illustrates a retorting process using at least one indirect heated gas stage wherein a relatively small amount of oxygen is added at a special point to improve control and response to the overall, inter-relations between the process conditions. It is recognized that changes may be made without departing from the spirit of the appended claims. For example, other gases may be added at various points in the system or through other distributors not shown. Sometimes, for example, it is desirable to add steam, hydrogen, carbon dioxide or the like to alter the retort products, or to control coking, or to control the maximum temperature, or to reduce the amount of sulfur or nitrogen compounds in the products.

The embodiments of the invention in which an exclusive property or privilege is claimed are defined as follows:

1. A method of retorting of the hydrocarbonaceous matter in crushed mined hydrocarbonaceous solids comprising:

(a) feeding crushed mined hydrocarbon solids to a retort;

(b) heating at least one moving stream of a first gas to a temperature of at least 600° F., said first gas being at least partially comprised of gaseous hydrocarbons derived from retorting hydrocarbonaceous solids;

(c) mixing outside of said retort at least a portion of said first gas heated in step (b) with a second gas, said second gas being at least partially comprised of molecular oxygen and being at a temperature less than the temperature of said portion of said heated first gas, said second gas being in an amount which is less than the amount needed to supply enough oxygen to react with all of the hydrocarbons in said portion of said heated first gas and which is at least as great as the calculated amount needed to supply enough oxygen to raise the temperature of said portion of said heated first gas at least 100° F. when, for purposes of such calculation, it is assumed that all of the oxygen in said second gas reacts with hydrocarbons in said portion of said heated first gas;

(d) flowing at least a portion of the mixture produced in step (c) into said retort at at least one point; and (e) operating said retort at a temperature of at least 700° F. to convert a substantial portion of the hydrocarbonaceous matter in the retorted hydrocarbonaceous solids to gases and oil vapors.

2. The method of claim 1 wherein in step (b), the first gas is heated to a temperature of at least 900° F.

3. The method of claim 1 wherein in step (d), the mixture is flowed into said retort at at least two points.

4. The method of claim 3 wherein in step (b), the first gas is heated to a temperature of at least 900° F.

5. The method of claim 1 wherein in step (c), the amount of said second gas is calculated to raise the temperature of said heated first gas mixed with said second gas between 100° F. and 900° F.

6. The method of claim 5 wherein in step (b), the first gas is heated to a temperature of at least 900° F.

7. The method of claim 5 wherein in step (d), the mixture is flowed into said retort at at least two points.

8. The method of claim 7 wherein in step (b), the first gas is heated to a temperature of at least 900° F.

* * * * *